United States Patent [19]

Brauer et al.

[11] Patent Number: 4,526,104

[45] Date of Patent: Jul. 2, 1985

[54] SAFETY-ARMING DEVICE

[75] Inventors: Larry F. Brauer; Roger W. Leach, both of Ridgecrest, Calif.

[73] Assignee: The United States of America as represented by the Secretary of the Navy, Washington, D.C.

[21] Appl. No.: 434,438

[22] Filed: Oct. 14, 1982

[51] Int. Cl.[3] ..... F42C 5/00; F42C 15/32

[52] U.S. Cl. ..... 102/228; 102/223; 102/263

[58] Field of Search ..... 102/223, 228, 229, 263, 102/264, 262

[56] References Cited

U.S. PATENT DOCUMENTS

| | | | |
|---|---|---|---|
| 2,110,552 | 3/1938 | Hayden | 102/206 |
| 2,827,850 | 3/1958 | Muzzey | 102/263 X |
| 2,913,984 | 11/1959 | Meek et al. | 102/247 |
| 3,416,451 | 12/1968 | Hamerla | 102/207 |
| 3,678,859 | 7/1972 | Wesson et al. | 102/223 |
| 3,780,659 | 12/1973 | Kulesza et al. | 102/228 |
| 3,927,617 | 12/1975 | Hoelzen et al. | 102/228 |
| 3,968,751 | 7/1976 | Palifka | 102/228 |
| 3,973,501 | 8/1976 | Briggs | 102/224 |
| 4,188,886 | 2/1980 | Brauer et al. | 102/223 |
| 4,202,271 | 5/1980 | Day | 102/262 X |
| 4,359,942 | 11/1982 | Schmidlin | 102/263 |
| 4,380,197 | 4/1983 | Eaton | 102/228 |

*Primary Examiner*—David H. Brown

*Attorney, Agent, or Firm*—Robert F. Beers; W. Thom Skeer; Kenneth G. Pritchard

[57] ABSTRACT

A safe-arm device for use in a fuel-air explosive munition carried by an aircraft. The device has a housing having an environmental seal which is separated from the housing upon munition release to form a seal opening, a pressure probe for obtaining static and dynamic air pressure and extending through the seal opening when deployed, a piston and rod which is driven upon sensing of a sufficient differential air pressure between the static and dynamic air pressure probe, a safety lock which locks a pyrotechnic rotor and which disengages upon full extension of the piston rod, and an arming spring which is compressed by extension of the piston rod and which drives the pyrotechnic rotor for rotation against a mechanical escapement device thus providing for a timed rotation. The pyrotechnic rotor has two explosive wheels, each having switched detonators and upon receipt of electronic signals two explosive trains with a controlled time delay therebetween are initiated.

9 Claims, 8 Drawing Figures

SAFETY-ARMING DEVICE

BACKGROUND OF THE INVENTION

1. Field of the Invention

This invention relates to the field of mechanics. More particularly, this invention relates to the field of pyrotechnic fuzes for ordnance. Still more particularly, but without limitation thereto, this invention relates to fuzes capable of delivering two distinct, separate, and isolated explosive outputs separated by a specific controlled time.

2. Description of the Prior Art

The purpose of prior safe-arm (S-A) devices or fuzes is to provide safety to the personnel during handling of a munition while providing capability to explode the munitions when delivered to the target area. The development of the fuel-air explosive munition placed a new requirement upon fuze devices. In the deployment of a fuel-air explosive munitions two precisely sequenced pyrotechnic impulses must be provided by the fuze, a first impulse to arm and deploy fuel-air cloud detonation devices and a controlled delayed second impulse to initiate dispersion of a liquid fuel into the atmosphere to form an explosive fuel-air cloud for detonation. No previous device is known to be capable of meeting these weapon system requirements.

SUMMARY OF THE INVENTION

An object of this invention is to provide an S-A device useful as a fuze for fuel-air explosive munitions.

A further object of this invention is to provide an S-A device capable of providing two distinct, separate, and isolated explosive outputs separated by a specific controlled time.

A still further object of this invention is to provide an S-A device capable of sensing its post release environment before arming a munition.

These and other objects are demonstrated in the present invention which includes an S-A device having a static-dynamic probe which is erected into the airstream surrounding a munition upon release of the munition from an aircraft. The pressure differential between static and dynamic probes drives a piston which unlocks a pyrotechnic rotor and stores energy in a rotor drive spring. The rotor is driven against a timing escapement to an armed position. The rotor contains two separate detonator wheels which when in the arm position align detonator switches with electrical switch contacts and the detonators with external pyrotechnic ignition trains. Electronic elements provide electrical impulses to fire the first detonator followed by firing the second detonator after a 28 millisecond time delay. Respective pyrotechnic ignition trains provide for deployment of fuel-air cloud detonators from the munition followed at a precisely timed interval by ignition of a fuel dispersion device.

DESCRIPTION OF THE PREFERRED EMBODIMENT

Figure 1A:
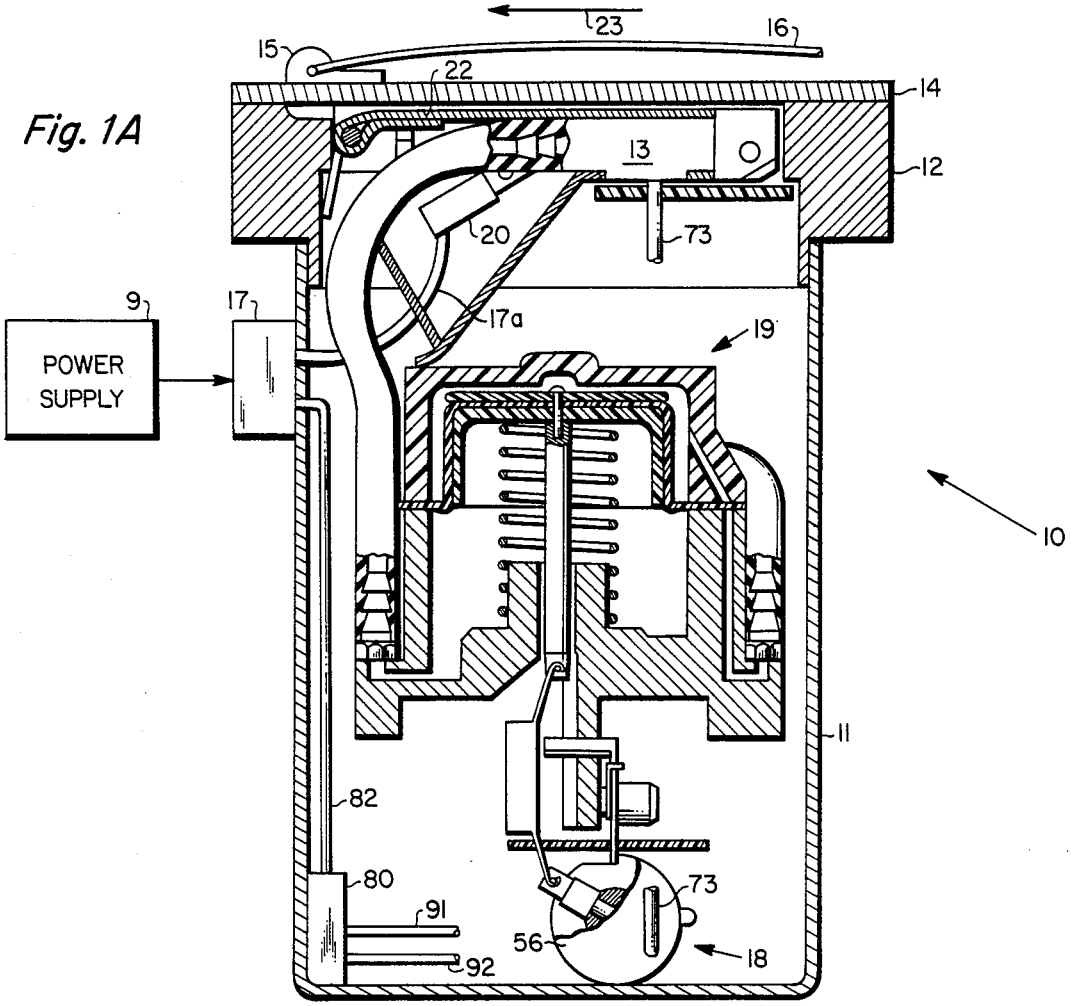
FIG. 1A is an elevation view, partially broken away, of a preferred embodiment in the "safe" position, FIG. 1B being a side detail view of the rod and pyrotechnic rotor assembly, also, partially broken away.

Referring to FIG. 1A safe-arm (S-A) device 10 consists of a metal can 11, a die-cast probe housing 12, a pressure probe 13, a pressure probe seal 14, a pull tab 15 and a pyrotechnic rotor assembly 18, and differential pressure actuator 19.

Figure 2B:
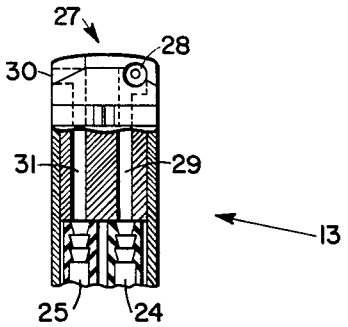
FIG. 2A is an elevation view, partially broken away, of the embodiment of FIG. 1A with the probe in the deployed position, FIG. 2B being a side detail view of the probe end portion.
Figure 2A:
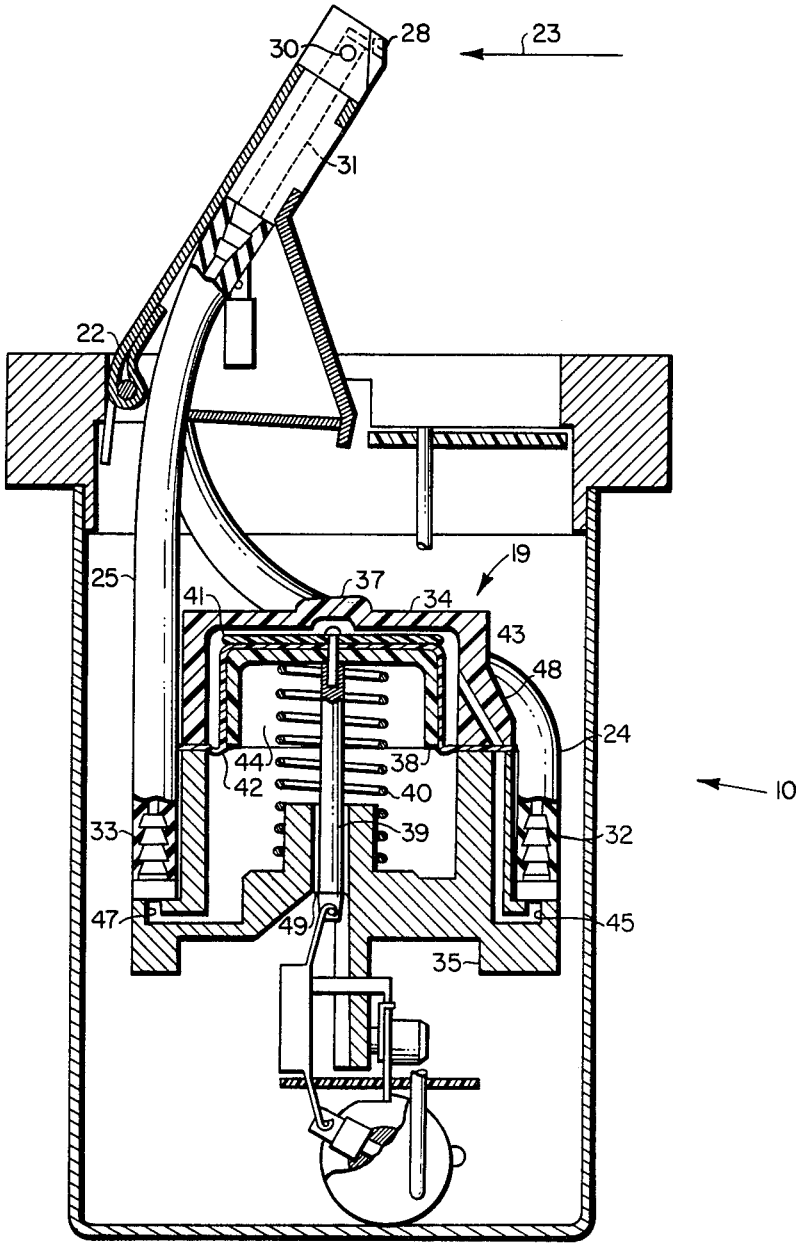

Upon proper release from an aircraft of a weapon having S-A device 10, two arming wires are pulled as a result of the weapon falling away from the aircraft. One wire 16 is connected to probe seal 14 via pull tab 15 which is pulled away leaving a portion of pressure probe 13 exposed while terminating the hermetic seal. The second arming wire (not shown) initiates a power source 9, such as a thermal battery of conventional design which provides electrical power to the S-A device 10 via a connector 17. An electrical signal from connector 17 is sent to pyrotechnic latch 20 via a wire 17A whereby pyrotechnic latch 20 fires, thus unlocking the pressure probe 13 and allowing probe spring 22 to force pressure probe 13 into an erect position in the airstream 23. When pressure probe 13 of S-A device 10 is in the erect position extending into airstream 23 as shown in FIG. 2A and 2B dynamic and static air pressure are measured and transmitted via dynamic tube 24 and static tube 25, respectively. As seen in FIG. 2B pressure probe 13 includes probe end portion 27 having dynamic port 28 connected by dynamic internal passage 29 to dynamic tube 24, and static port 30 connected by static internal passage 31 to static tube 25. Dynamic tube 24 and static tube 25 are attached at their respective remote ends to differential pressure actuator 19 by means of dynamic actuator nipple 32 and static actuator nipple 33. Differential pressure actuator 19 includes a housing 34 having base 35 and a cap 37, a piston 38 having a rod 39, a safety spring 40, a cover 41 and a rolling rubber diaphragm seal 42. Piston 38 and diaphragm seal 42 divide the interior of housing 34 into a dynamic pressure cavity 43 and a static pressure cavity 44. Dynamic pressure cavity 43 is connected to dynamic tube 24 via passage 45 and static pressure cavity 44 is connected to static tube 25 by means of passage 47 in base 35 and passage 48 in cap 37. Cover 41 provides a flat surface above piston 38 and a solid surface for the retaining screw. If the static to dynamic pressure differential is sufficient, the differential pressure forces piston 38 to compress safety spring 40 thus moving rod 39 along bore 49 and thus extending outside to the arm position as shown in FIG. 3.

Figure 1B:
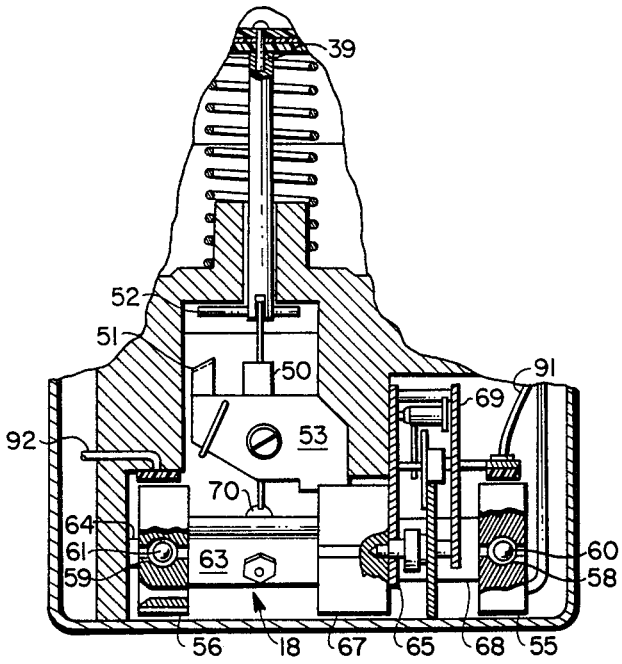
Figure 3:
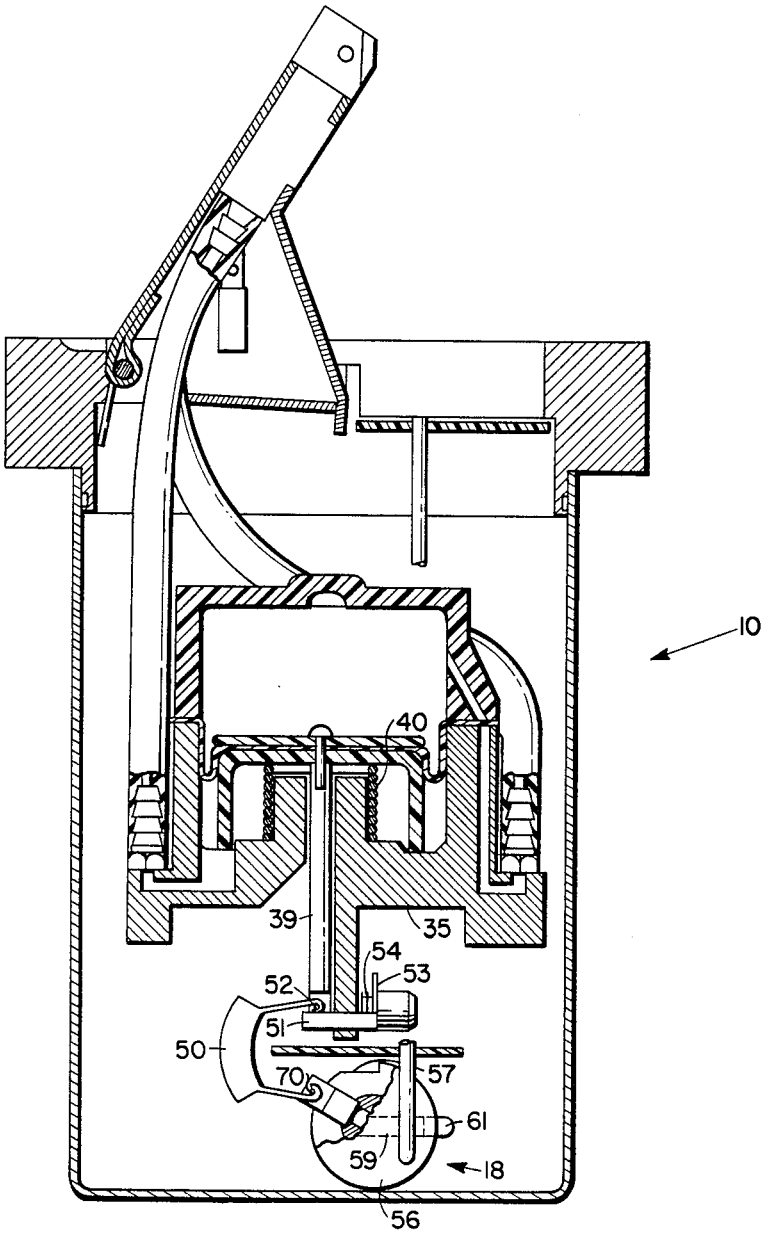
FIG. 3 is an elevation view, partially broken away, of the embodiment of FIG. 2A with the actuator piston and rod in the extended position and the arming spring compressed.

Referring to FIGS. 1B, and 3, as rod 39 of S-A device 10 completes its stroke, compressing safety spring 40, arming spring 50 is compressed and roll pin 52 engages striker arm 51 rotating pivotable rotor lock 53 against the force of rotor lock spring 54 and, thus, disengaging it from detent 57 of pyrotechnic rotor assembly 18. Pyrotechnic rotor assembly 18 includes detonator wheels 55 and 56 having detonators 58 and 59 and contact switches 60 and 61, respectively. Detonator wheel 56 is mounted on axle 63 supported for rotation in actuator base 35 by means of bearings 64 and 65. Crank 67 is mounted on axle 63 and is attached to detonator wheel 55 by means of crank pin 68. Escapement 69 is of well known design and is attached to crank 67 at its central axis. Drive pin 70 is located on axle 63 and attached to arming spring 50.

Figure 4B:
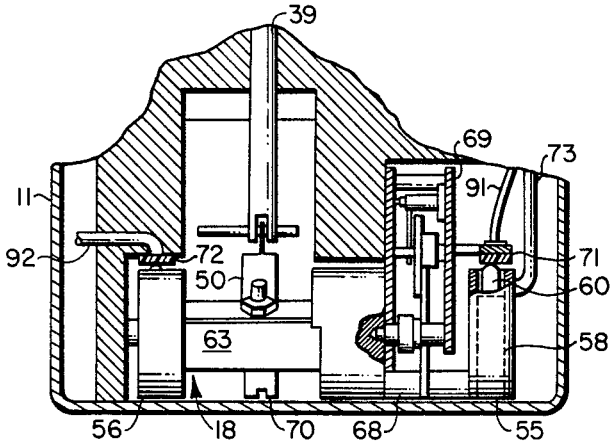
FIG. 4A is an elevation view, partially broken away, of the embodiment of FIG. 3 with the pyrotechnic rotor in the "arm" position, FIG. 4B being a side detail view of the rod and pyrotechnic rotor assembly, also, partially broken away.
FIG. 4C is a side detail view of a detonator wheel of the pyrotechnic rotor.
Figure 4A:
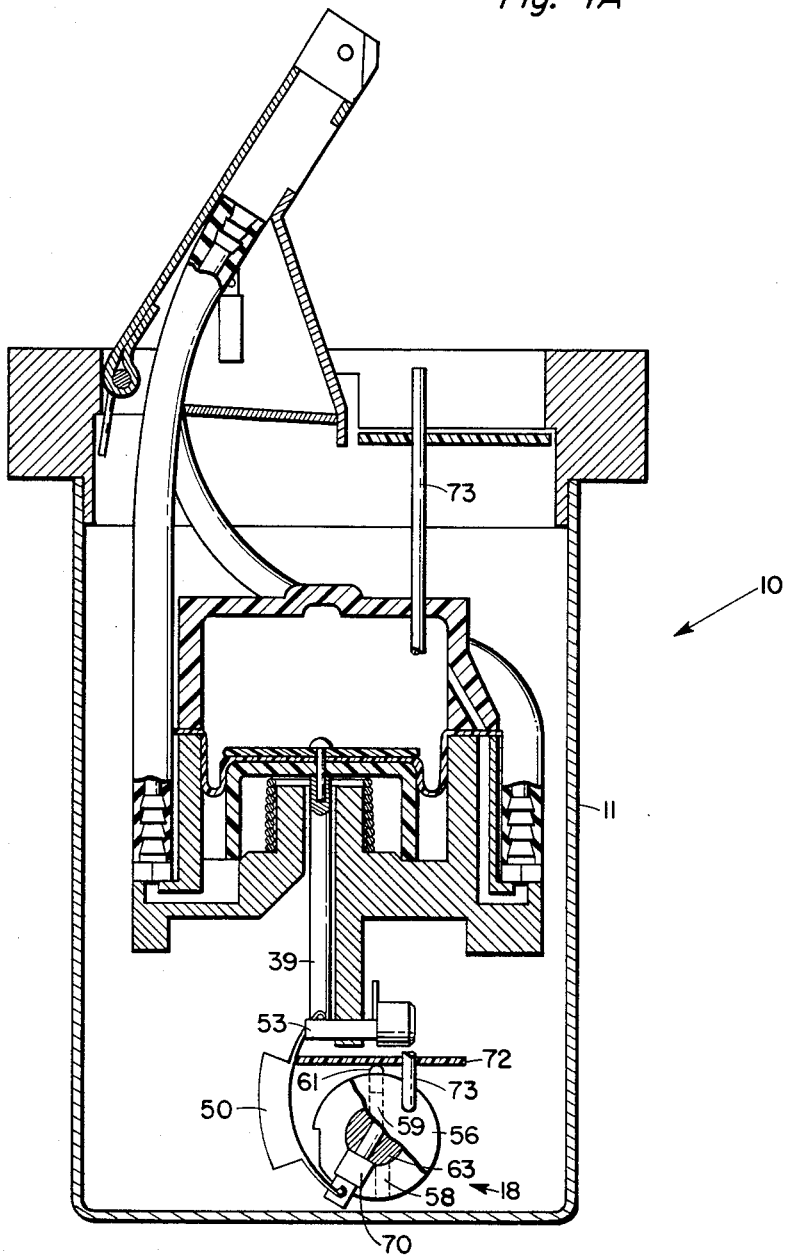
Figure 4C:
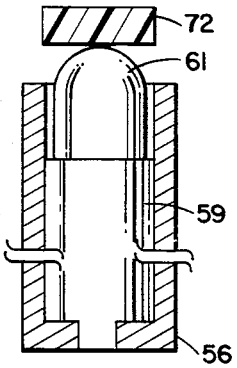

Referring to FIGS. 1A, 1B, 4A, 4B, and 4C upon disengagement of rotor lock 53 of S-A device 10 arming spring 50, compressed by the stroke of rod 39, exerts force against drive pin 70 in axle 63 in turn rotating pyrotechnic rotor assembly 18. Rotation time of rotor assembly 18 is controlled by means of escapement 69, rotation occurring from the safe position as in FIGS. 1A, 1B to the arm position as in FIGS. 4A, 4B. As shown in FIGS. 4A and 4B, contact switches 60 and 61 are closed against switch contacts 71 and 72 when pyrotechnic rotor assembly 18 is rotated to the armed position. Also, gag rod 73, a safety interlock eccentrically mounted in detonator wheel 55 (shown in the elevation views as mounted in detonator wheel 56 for illustrative purposes) is displaced upon rotation to the arm position. Note that the remote end of gag rod 73 interferes with pressure probe 13 when in the stored position as in FIG. 1A thus preventing premature rotation of pyrotechnic rotor assembly 18. At the same time that electrical power is provided via connector 17 to latch 20, power is also provided via wire 82 to an electronic time delay circuit 80 of conventional design located within the S-A device 10. Time delay circuit 80 runs two separate time delays. At the end of the first time delay, a firing pulse is sent via wire 91 to switch contact 71. At the end of the second time delay, a second firing pulse is sent via wire 92 to switch contact 72. With the rotor assembly 18 in the armed position as shown in FIGS. 4A and 4B, the first firing pulse triggers detonator 58 via switch contact 71 and switch 60. The second firing plate triggers detonator 59 via contact 72 and switch 61 after a preset time delay difference from the first firing pulse. Firing detonators 58 and 59 blows holes in metal can 11 and provide pyrotechnic impulse to respective ignition trains, not shown, located adjacent the wall of can 11. The detonation of the two ignition trains in the proper delayed sequence is the final safety control. Crank pin 68 is placed so that it does not transmit the detonation shock to the second detonator wheel. If the shock is transmitted, premature firing of the second detonator will occur.

The electronic components of the connectors and time delay circuit, such as, firing capacitors, detonator switches, and associated electrical wiring are conventional in the art and form no part of the invention. For the sake of clarity most individual electrical components are not presented in the drawings. All electronic devices could be mounted external to the inventive S-A device with the only connections being to provide power to the latch 20 and the contacts 71, 72 so as to provide firing signals to the detonator wheels 55, 56. Time delay circuit 80 does not have to be in metal can 11 or after connector 17 in the wiring.

Obviously, many modifications and variations of the present invention are possible in light of the above teachings. It is therefore to be understood that within the scope of the appended claims, the invention may be practiced otherwise than as specifically described.

We claim:

1. A safety-arming, S-A, device for mounting in a munition requiring two firing pulses comprising:

(a) a housing with an environmental seal;

(b) means for removing said environmental seal from said housing upon deployment of said S-A device;

(c) a spring loaded pressure probe pivotally mounted within said housing, said pressure probe having a dynamic port;

(d) a latch mechanism connected to said spring loaded pressure probe such that when activated, said latch mechanism moves said spring loaded pressure probe from a stored position within said housing to an extended position where said dynamic port is external to said housing;

(e) actuating means receiving air pressure from said pressue probe, said actuating means having a piston responsive to a sufficient pressure differential between said static and dynamic air pressure, said piston driving an actuator rod;

(f) a rotor assembly having at least two detonator wheels, each detonator wheel containing detonator means and detonator switch means, said rotor having a safe and an arm position;

(g) an arming spring attached to said actuator rod and said rotor assembly such that, upon displacement of said actuator rod by said piston, said arming spring is compressed so as to provide motive force to rotate said rotor assembly from said safe to said arm position; and (h) a timing delay circuit electrically connected to both of said detonator switch means when said rotor assembly is in said arm position whereby a first firing pulse is transmitted after a first time delay to said detonator switch means for firing said detonator means located in said first detonator wheel, and whereby a second firing pulse is transmitted after a second time delay to said detonator switch means for firing said detonator means located in said second detonator wheel.

2. The S-A device of claim 1 wherein said rotor assembly further comprises a crank located between said detonator wheels, an axle located between the second of said detonator wheels and said crank, and an eccentrically located crank pin between said crank and said first detonator wheel.

3. The S-A device of claim 1 wherein said rotor assembly is locked in the safe position by a spring loaded rotor lock and said actuator rod further comprises a roll pin and wherein upon displacement of said actuator rod, said roll pin engages a striker arm which rotates said rotor lock, moving said rotor lock to a position whereby said rotor assembly is unlocked, allowing rotation from the safe to the arm position.

4. The S-A device of claim 1 wherein said rotor assembly is operatively connected with mechanical escapement means whereby the rate of movement of said rotor from said safe position to said arm position is accurately controlled.

5. The S-A device of claim 4 wherein said rotor assembly further comprises a gag rod eccentrically mounted to one of said detonator wheels and extending to the vicinity of said probe whereby said rod is linearly displaced upon rotation of said rotor from the safe to the arm position when said probe is in the extended position, while linear displacement of said gag rod is prevented, thus preventing rotor rotation and arming, by mechanical interference with said probe when said probe is in said stored position.

6. The S-A device of claim 1 wherein said latch mechanism further comprises a pyrotechnic latch maintaining said probe in said stored position and whereupon receipt of a predetermined signal, said pyrotechnic latch detonates, allowing said spring loaded pressure probe to extend said probe to the deployed position.

7. The S-A device of claim 6 further comprising electrical connector means for supplying externally generated electrical signals to said pyrotechnic latch and said timing delay circuit.

8. The S-A device of claim 1 wherein said probe further comprises a probe end portion having a static port opening into an integral static passage and a dynamic port opening into an integral dynamic passage, said probe further comprising a static tube connected with said static passage and a dynamic tube connected with said dynamic passage.

9. The S-A device of claim 8 wherein said actuator further comprises a safety spring, an actuator cap, an actuator base, a static pressure cavity between said actuator cap and said piston, a dynamic pressure cavity between said piston and said actuator base, said safety spring extending between said piston and an opposite wall of said actuator base and within said static pressure cavity, said actuator rod extending through a bore in said actuator base, said static tube of said probe being connected to said static pressure cavity and said dynamic tube of said probe being connected to said dynamic pressure cavity, whereby static air pressure is transmitted through said static port, passage, and tube to said static pressure cavity and dynamic air pressure is transmitted through said dynamic port, passage, and tube to said dynamic pressure cavity, said pressure differential necessarily overcoming the force of said safety spring to force said piston to drive said rod and thus arm said S-A device.

* * * * *